US011913664B2

(12) United States Patent
Asanuma et al.

(10) Patent No.: US 11,913,664 B2
(45) Date of Patent: Feb. 27, 2024

(54) AIR-CONDITIONING APPARATUS AND METHOD OF CONTROLLING THE SAME

(71) Applicant: Mitsubishi Electric Corporation, Tokyo (JP)

(72) Inventors: Hiroaki Asanuma, Tokyo (JP); Hiroyuki Okano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 366 days.

(21) Appl. No.: 17/441,429

(22) PCT Filed: Jun. 3, 2019

(86) PCT No.: PCT/JP2019/021968
§ 371 (c)(1),
(2) Date: Sep. 21, 2021

(87) PCT Pub. No.: WO2020/245871
PCT Pub. Date: Dec. 10, 2020

(65) Prior Publication Data
US 2022/0178579 A1 Jun. 9, 2022

(51) Int. Cl.
*B25B 1/06* (2006.01)
*F24F 11/86* (2018.01)
(Continued)

(52) U.S. Cl.
CPC ..... *F24F 11/86* (2018.01); *F25B 1/04* (2013.01); *F25B 13/00* (2013.01); *F25B 2700/21152* (2013.01)

(58) Field of Classification Search
CPC ... F24F 11/86; F25B 1/04; F25B 13/00; F25B 2700/21152
(Continued)

(56) References Cited

U.S. PATENT DOCUMENTS

2017/0370608 A1 12/2017 Okochi

FOREIGN PATENT DOCUMENTS

JP H08-200869 A 8/1996
JP H11-142010 A 5/1999
(Continued)

OTHER PUBLICATIONS

International Search Report of the International Searching Authority dated Aug. 20, 2019 for the corresponding International application No. PCT/JP2019/021968 (and English translation).
(Continued)

*Primary Examiner* — Davis D Hwu
(74) *Attorney, Agent, or Firm* — POSZ LAW GROUP, PLC

(57) ABSTRACT

An air-conditioning apparatus including heat source apparatuses each including a compressor and an accumulator includes: a refrigerant amount calculation unit that calculates an amount of the refrigerant accumulated in the accumulator in one of the heat source apparatuses that is to be controlled; a refrigerant differential amount calculation unit configured to calculate, when the number of the heat source apparatuses is two, a differential amount between the calculated amount and an amount of the refrigerant in the accumulator in the other heat source apparatus, and calculate, when the number of the heat source apparatuses is three or more, a differential amount between the calculated amount of the refrigerant and an average amount of amounts of the refrigerant accumulated in the accumulators in the heat source apparatuses; and a liquid equalization control unit that controls the heat source apparatus to be controlled, based on the calculated differential amount.

10 Claims, 5 Drawing Sheets

(51) Int. Cl.
*F25B 1/04* (2006.01)
*F25B 13/00* (2006.01)

(58) Field of Classification Search
USPC ..... 62/190
See application file for complete search history.

(56) References Cited

FOREIGN PATENT DOCUMENTS

| | | | |
|---|---|---|---|
| JP | 2010-203733 | A | 9/2010 |
| JP | 2010-261715 | A | 11/2010 |
| JP | 2011-247443 | A | 12/2011 |
| JP | 2011-247504 | A | 12/2011 |
| WO | 2016/117126 | A1 | 7/2016 |

OTHER PUBLICATIONS

Office Action dated Aug. 30, 2022 issued in corresponding JP Patent Application No. 2021-524508 (and English translation).

AIR-CONDITIONING APPARATUS AND METHOD OF CONTROLLING THE SAME

CROSS REFERENCE TO RELATED APPLICATION

This application is a U.S. national stage application of International Patent Application No. PCT/JP2019/021968 filed on Jun. 3, 2019, the disclosure of which is incorporated herein by reference.

TECHNICAL FIELD

The present disclosure relates to an air-conditioning apparatus in which a plurality of heat source apparatuses each including an accumulator are used in combination, and to a method of controlling the air-conditioning apparatus.

BACKGROUND ART

Some of existing air-conditioning apparatuses use a plurality of outdoor units in combination. Each of the outdoor units serves as a heat source apparatus and includes a compressor, an outdoor-unit heat exchanger, and an accumulator. Such an air-conditioning apparatus includes flow control valves that control the flow rates of refrigerant that flows into the respective accumulators, and that are provided between a common liquid pipe and the outdoor-unit heat exchangers of the outdoor units.

In the case of performing a liquid equalization control in such an air-conditioning apparatus as described above, the degree of superheat on an outlet side of the outdoor-unit heat exchanger of each of the outdoor units and the degree of discharge superheat of the compressor of each outdoor unit are measured. Furthermore, the opening degree of each of the flow control valves is controlled based on the result of the measurement such that the degree of superheat on the outlet side of an associated one of the outdoor units falls within a range and the degree of discharge superheat of an associated one of the compressors falls within a range.

CITATION LIST

Patent Literature

Patent Literature 1: Japanese Unexamined Patent Application Publication No. 2010-261715

SUMMARY OF INVENTION

Technical Problem

The degree of discharge superheat of the compressor varies depending on specifications of the accumulator, the type of refrigerant used, and an operation state such as the pressure and frequency of the air-conditioning apparatus. Therefore, in the case of performing the liquid equalization control, it is necessary to previously and sufficiently grasp characteristics of the air-conditioning apparatus.

For the degree of discharge superheat of the compressor, a threshold is set as a control target value. However, it is necessary to appropriately set different thresholds for respective compressors in the air-conditioning apparatus.

The present disclosure is applied in consideration of the above circumstances, and relates to an air-conditioning apparatus that accurately grasps amounts of refrigerant accumulated in accumulators in the air-conditioning apparatus without being affected by the degrees of discharge superheat of compressors and the kind of the refrigerant, thereby accurately performing a liquid equalization control, and also relates to a method of controlling the air-conditioning apparatus.

Solution to Problem

An air-conditioning apparatus according to an embodiment of the present disclosure includes a plurality of heat source apparatuses. Each of the plurality of heat source apparatuses includes a compressor and an accumulator that accumulates refrigerant to be compressed by an associated one of the compressors. The air-conditioning apparatus includes: a refrigerant amount calculation unit configured to calculate an amount of the refrigerant accumulated in the accumulator in one of the plurality of heat source apparatuses that is to be controlled; a refrigerant differential amount calculation unit configured to calculate, in a case where the number of the plurality of heat source apparatuses is two, a differential amount between the amount of the refrigerant that is calculated by the refrigerant amount calculation unit and an amount of the refrigerant in the accumulator in an other one of the heat source apparatuses, and configured to calculate, in a case where the number of the plurality of heat source apparatuses is three or more, a differential amount between the amount of the refrigerant that is calculated by the refrigerant amount calculation unit and an average amount of amounts of the refrigerant accumulated in the accumulators in the plurality of heat source apparatuses; and a liquid equalization control unit configured to control the heat source apparatus to be controlled, based on the differential amount calculated by the refrigerant differential amount calculation unit, to thereby equalize the amounts of the refrigerant accumulated in the accumulators in the plurality of heat source apparatuses.

Advantageous Effects of Invention

According to the embodiment of the present disclosure, the liquid equalization control is performed on the accumulators of the heat source apparatuses based on the differential amount of the refrigerant. Therefore, it is possible to accurately grasp the amounts of the refrigerant accumulated in the respective accumulators in the air-conditioning apparatus without being affected by the degree of discharge superheat of each of the compressors and the kind of the refrigerant. As a result, it is possible to perform an accurate liquid equalization control.

DESCRIPTION OF EMBODIMENTS

Figure 1:
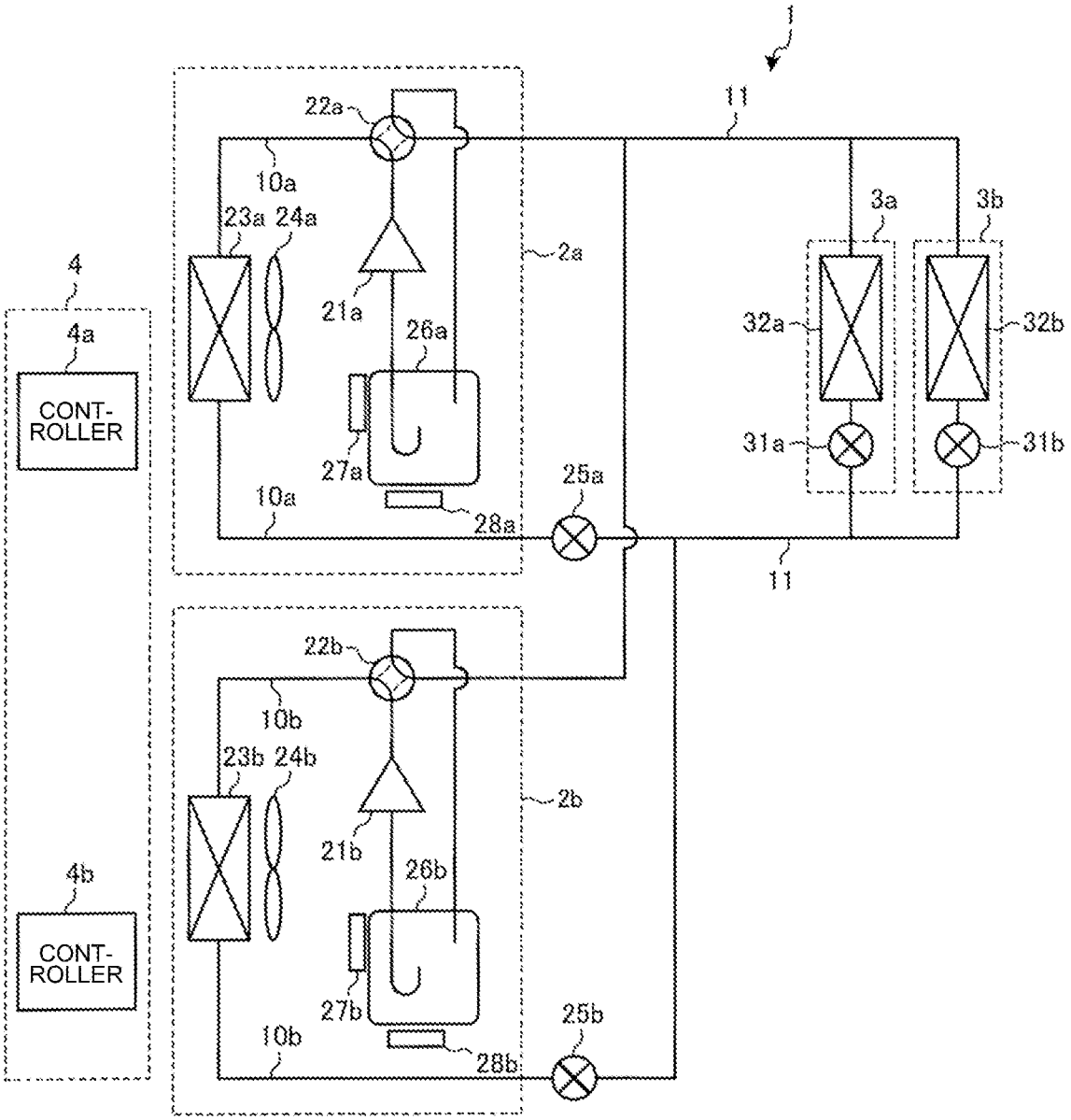
FIG. 1 is a diagram illustrating an air-conditioning apparatus according to an embodiment.

An air-conditioning apparatus according to an embodiment will be described below with reference to the drawings. It should be noted that in each of the figures in the drawings, components that are same as those in a previous figure or figures are denoted by the same reference sings, and after the components are each described once, their descriptions will not be repeated, except when the necessity arises. Furthermore, regarding the embodiment, in the case where it is unnecessary to distinguish components, the components will be collectively denoted by the same reference sign. For example, in the case where it is unnecessary to distinguish an outdoor unit 2*a* and an outdoor unit 2*b*, each of the outdoor units 2*a* and 2*b* will be referred to as an outdoor unit 2.

Embodiment

FIG. 1 is a diagram illustrating an air-conditioning apparatus 1 according to an embodiment.

As illustrated in FIG. 1, the air-conditioning apparatus 1 includes two outdoor units 2*a* and 2*b* serving as heat source apparatuses, two indoor units 3*a* and 3*b*, and a controller 4. The controller 4 includes controllers 4*a* and 4*b*. One of the controllers 4*a* and 4*b* may be made to fulfill the functions of both the controllers 4*a* and 4*b*.

The outdoor unit 2*a* is connected to the indoor unit 3*a* and the indoor unit 3*b* by a refrigerant pipe 10*a* and a common pipe 11. The outdoor unit 2*b* is connected to the indoor unit 3*a* and the indoor unit 3*b* by a refrigerant pipe 10*b* and the common pipe 11.

The outdoor unit 2*a* includes a compressor 21*a*, a four-way valve 22*a*, an outdoor-unit heat exchanger 23*a*, a fan 24*a*, a flow control valve 25*a*, an accumulator 26*a*, a liquid level detection device 27*a*, and a pressure measurement device 28*a*.

The refrigerant pipe 10*a* connected to the compressor 21*a* extends to refrigerant accumulated in the accumulator 26*a*. The compressor 21*a* sucks the refrigerant accumulated in the accumulator 26*a*, compresses the refrigerant into high-temperature and high-pressure gas refrigerant, and discharges the high-temperature and high-pressure gas refrigerant.

The four-way valve 22*a* is connected to a discharge side of the compressor 21*a* by the refrigerant pipe 10*a*. The four-way valve 22*a* is a flow switching valve that switches an operation to be performed between a cooling operation and a heating operation.

The outdoor-unit heat exchanger 23*a* is connected to one of flow passages of the four-way valve 22*a* by the refrigerant pipe 10*a*. The outdoor-unit heat exchanger 23*a* causes heat exchange to be performed between outside air and refrigerant that flows through the refrigerant pipe 10*a*. Furthermore, the fan 24*a* is provided close to the outdoor-unit heat exchanger 23*a*, and promotes evaporation of refrigerant at the outdoor-unit heat exchanger 23*a* to increase the amount of evaporation of the refrigerant.

Furthermore, the flow control valve 25*a* is provided at the refrigerant pipe 10*a* between the outdoor-unit heat exchanger 23*a* and the common pipe 11 and adjusts the flow rate of refrigerant that flows through the outdoor-unit heat exchanger 23*a*.

The accumulator 26*a* is a storage container that stores surplus refrigerant.

The liquid level detection device 27*a* measures the level of a liquid surface of the surplus refrigerant accumulated in the accumulator 26*a*, and calculates the volume of the refrigerant from the measured level of the liquid surface. The liquid level detection device 27*a* outputs the calculated volume of the refrigerant to the controller 4*a*.

The pressure measurement device 28*a* measures the pressure of the refrigerant in the accumulator 26*a*. The pressure measurement device 28*a* measures the pressure of the refrigerant in the accumulator 26*a* by, for example, measuring pressures at an inlet and an outlet of the accumulator 26*a*.

The outdoor unit 2*b* includes a compressor 21*b*, a four-way valve 22*b*, an outdoor-unit heat exchanger 23*b*, a fan 24*b*, a flow control valve 25*b*, an accumulator 26*b*, a liquid level detection device 27*b*, and a pressure measurement device 28*b*.

The refrigerant pipe 10*b* connected to the compressor 21*b* extends to refrigerant that is accumulated in the accumulator 26*b*. The compressor 21*b* sucks the refrigerant accumulated in the accumulator 26*b*, compresses the refrigerant into high-temperature and high-pressure gas refrigerant, and discharges the high-temperature and high-pressure gas refrigerant.

The four-way valve 22*b* is connected to a discharge side of the compressor 21*b* by the refrigerant pipe 10*b*. The four-way valve 22*b* is a flow switching valve that switches an operation to be performed between the cooling operation and the heating operation.

The outdoor-unit heat exchanger 23*b* is connected to one of flow passages in the four-way valve 22*b* by the refrigerant pipe 10*b*. The outdoor-unit heat exchanger 23*b* causes heat exchange to be performed between outside air refrigerant that flows through the refrigerant pipe 10*b*. Furthermore, the fan 24*b* is provided close to the outdoor-unit heat exchanger 23*b*, and promote evaporation of the refrigerant at the outdoor-unit heat exchanger 23*b* to increase the amount of evaporation of the refrigerant.

The flow control valve 25*b* is provided at the refrigerant pipe 10*b* between the outdoor-unit heat exchanger 23*b* and the common pipe 11, and adjusts the flow rate of refrigerant that flows in the outdoor-unit heat exchanger 23*b*.

The accumulator 26*b* is a storage container in which surplus refrigerant is accumulated.

The liquid level detection device 27*b* measures the level of a liquid surface of the surplus refrigerant accumulated in the accumulator 26*b*, and calculates the volume of the refrigerant from the measured level of the liquid surface. The liquid level detection device 27*b* outputs the calculated volume of the refrigerant to the controller 4.

The pressure measurement device 28*b* measures the pressure of the refrigerant in the accumulator 26*b*. For example, the pressure measurement device 28*b* measures pressures at an inlet and an outlet of the accumulator 26*b* to measure the pressure of the refrigerant in the accumulator 26*b*.

The common pipe 11 communicates with the refrigerant pipe 10*a* and the refrigerant pipe 10*b*. The indoor unit 3*a* and the indoor unit 3*b* are connected in parallel with the common pipe 11.

The indoor unit 3*a* includes an expansion valve 31*a* and an indoor-unit heat exchanger 32*a*. The indoor unit 3*a* causes heat exchange to be performed between outside air and refrigerant that flows through the common pipe 11. The expansion valve 31*a* is an electronic expansion valve whose opening degree is variably controlled.

The indoor unit 3*b* includes an expansion valve 31*b* and an indoor-unit heat exchanger 32*b*. The indoor unit 3*b* causes heat exchange to be performed between outside air and refrigerant that flows through the common pipe 11. The expansion valve 31*b* is an electronic expansion valve whose opening degree is variably controlled.

The controller 4*a* performs calculation of a refrigerant differential amount and a liquid equalization control of the outdoor unit 2*a* according to the embodiment, and controls the entire outdoor unit 2*a* and the entire indoor unit 3*a*.

The controller 4*a* is provided for the outdoor unit 2*a*, and calculates the refrigerant differential amount based on a liquid amount of refrigerant that is calculated by the liquid level detection device 27*a* of the compressor 21*a* in the outdoor unit 2*a* and a liquid amount of refrigerant that is calculated by the liquid level detection device 27*b* of the compressor 21*b* in the outdoor unit 2*b*.

Furthermore, the controller 4*a* performs the liquid equalization control on the compressor 21*a* of the outdoor unit 2*a* based on the calculated refrigerant differential amount.

The controller 4*b* performs calculation of a refrigerant differential amount and the liquid equalization control of the outdoor unit 2*b* according to the embodiment, and controls the entire outdoor unit 2*b* and the entire indoor unit 3*b*.

The controller 4*b* is provided for the outdoor unit 2*b*, and calculates the refrigerant differential amount based on a liquid amount of refrigerant that is calculated by the liquid level detection device 27*b* of the compressor 21*b* in the outdoor unit 2*b* and a liquid amount of refrigerant that is calculated by the liquid level detection device 27*a* of the compressor 21*a* in the outdoor unit 2*a*. Furthermore, the controller 4*b* performs the liquid equalization control on the compressor 21*b* of the outdoor unit 2*b* based on the calculated differential amount.

Figure 2:
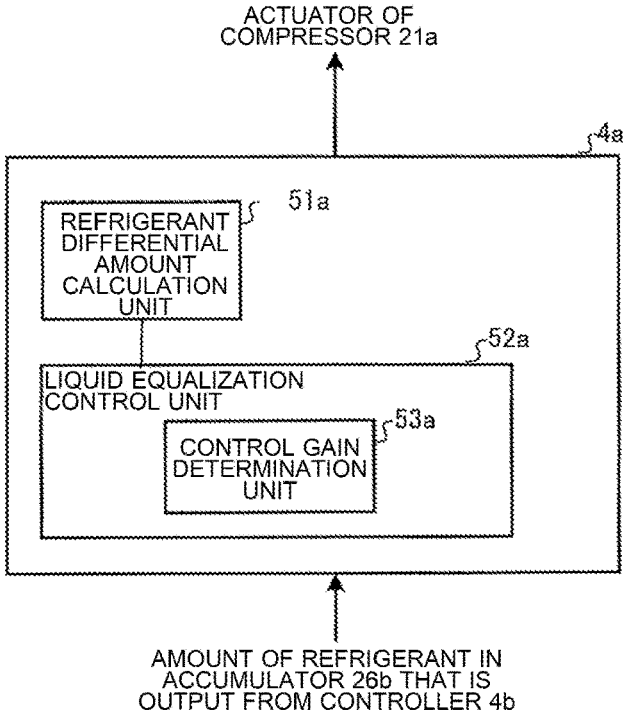
FIG. 2 is a functional block diagram illustrating functions of a controller according to the embodiment.

FIG. 2 is a functional block diagram illustrating functions of the controller 4*a* according to the embodiment.

As illustrated in FIG. 2, the controller 4*a* includes a refrigerant differential amount calculation unit 51*a* and a liquid equalization control unit 52*a*.

The refrigerant differential amount calculation unit 51*a* calculates a differential amount between an amount of the surplus refrigerant accumulated in the accumulator 26*a* that is calculated by the liquid level detection device 27*a* and the amount of refrigerant in the accumulator 26*b* of the outdoor unit 2*b*. Regarding the embodiment, the following description is made in the case where the two heat source apparatuses each including the accumulator are provided; however, in the case where three or more heat source apparatuses are provided, a differential amount between an amount of the surplus refrigerant accumulated in the accumulator 26*a* that is calculated by the liquid level detection device 27*a* and the average amount of amounts of refrigerant accumulated in accumulators of a plurality of heat source apparatuses is calculated as described below.

The liquid equalization control unit 52*a* controls the outdoor unit 2*a* based on the differential amount calculated by the refrigerant differential amount calculation unit 51*a* to equalize the amount of the refrigerant accumulated in the accumulator 26*a* of the outdoor unit 2*a* and the amount of the refrigerant accumulated in the accumulator 26*b* of the outdoor unit 2*b*. Specifically, the liquid equalization control unit 52*a* controls a rotational frequency of the compressor 21*a*.

More specifically, the liquid equalization control unit 52*a* includes a control gain determination unit 53*a*. The control gain determination unit 53*a* determines a control gain of the compressor 21*a* based on the differential amount calculated by the refrigerant differential amount calculation unit 51*a*. The liquid equalization control unit 52*a* controls an actuator that controls the rotational frequency of the compressor 21*a*, based on the control gain determined by the control gain determination unit 53*a*.

Figure 3:
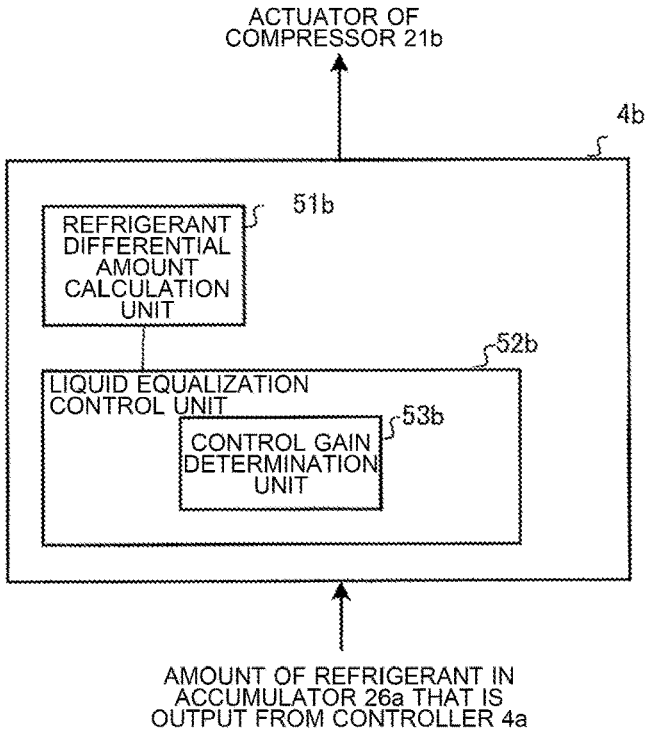
FIG. 3 is a functional block diagram illustrating functions of another controller according to the embodiment.

FIG. 3 is a functional block diagram illustrating functions of the controller 4*b* according to the embodiment.

As illustrated in FIG. 3, the controller 4*b* includes a refrigerant differential amount calculation unit 51*b* and a liquid equalization control unit 52*b*.

The refrigerant differential amount calculation unit 51*b* calculates a differential amount between an amount of the surplus refrigerant accumulated in the accumulator 26*b* that is calculated by the liquid level detection device 27*b* and the amount of refrigerant in the accumulator 26*a* of the outdoor unit 2*a*. In the embodiment, the following description is made with respect to the case where the two heat source apparatuses each including the accumulator are provided; however, in the case where three or more heat source apparatuses are provided, a differential amount between the amount of the surplus refrigerant accumulated in the accumulator 26*b* that is calculated by the liquid level detection device 27*a* and an average amount of amounts of the refrigerant accumulated in the accumulators of the plurality of heat source apparatuses is calculated as described below.

The liquid equalization control unit 52*b* controls the outdoor unit 2*b* based on the differential amount calculated by the refrigerant differential amount calculation unit 51*b* to equalize the amount of the refrigerant accumulated in the accumulator 26*b* of the outdoor unit 2*b* and the amount of the refrigerant accumulated in the accumulator 26*a* of the outdoor unit 2*a*. Specifically, the liquid equalization control unit 52*b* controls a rotational frequency of the compressor 21*b*.

More specifically, the liquid equalization control unit 52*b* includes a control gain determination unit 53*b*. The control gain determination unit 53*b* determines a control gain of the compressor 21*b* based on the differential amount calculated by the refrigerant differential amount calculation unit 51*b*. The liquid equalization control unit 52*b* controls an actuator that controls the rotational frequency of the compressor 21*b*, based on the control gain determined by the control gain determination unit 53*b*.

Next, operations according to the embodiment will be described.

Figure 4:
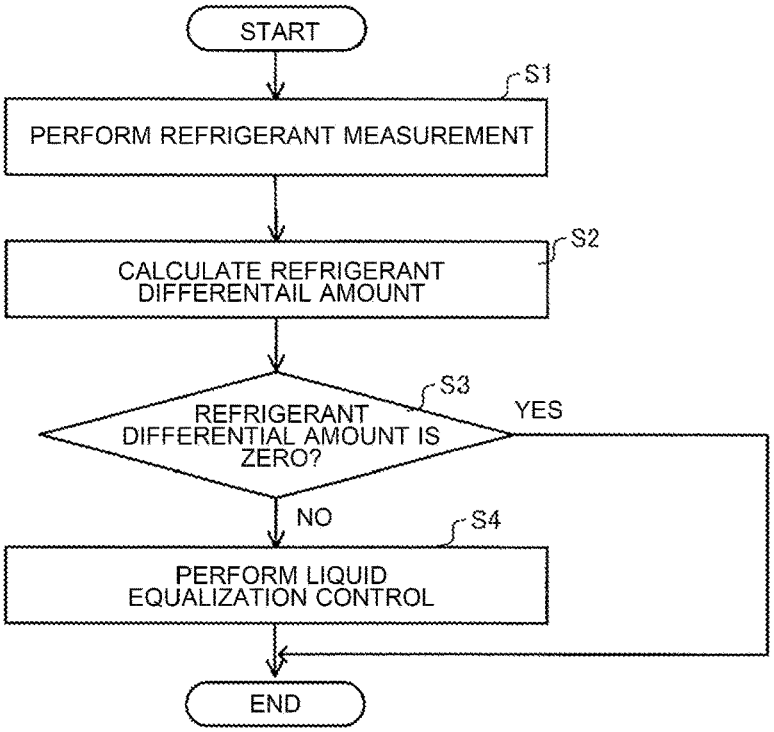
FIG. 4 is a flowchart to explanation of operations of the air-conditioning apparatus according to the embodiment.

FIG. 4 is a flowchart for use in explanation of operations of the air-conditioning apparatus according to the embodiment. The operations as indicated in FIG. 4 are performed by the liquid level detection device 27*a* of the outdoor unit 2*a* and the controller 4*a* or the liquid level detection device 27*b* of the outdoor unit 2*b* and the controller 4*b*. The outdoor unit 2*a* will be described as a representative. The liquid level detection device 27*b* of the outdoor unit 2*b* and the controller 4*b* also perform similar operations to operations by the liquid level detection device 27*a* of the outdoor unit 2*a* and the controller 4*a*.

First, the liquid level detection device 27*a* performs refrigerant measurement to measure the amount of the surplus refrigerant accumulated in the accumulator 26*a* (S1).

Figure 5:
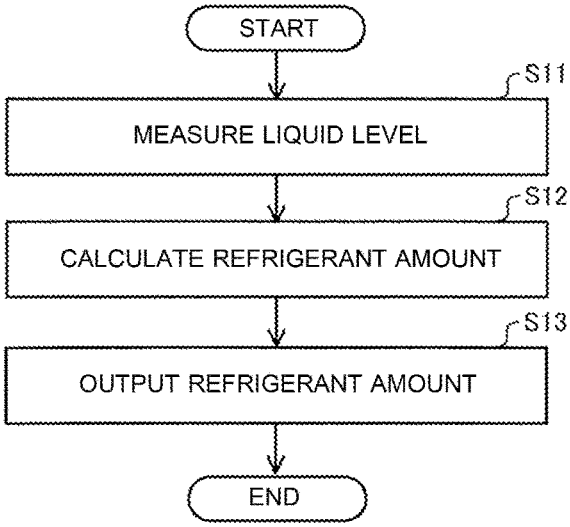
FIG. 5 is a flowchart for use in explanation of an operation of a liquid level detection device according to the embodiment.

An operation by the liquid level detection device 27*a* in step S1, that is, the refrigerant measurement, will be described. FIG. 5 is a flowchart for use in explanation of the operation of the liquid level detection device 27*a* according to the embodiment.

The liquid level detection device 27*a* measures the level of a liquid surface of the surplus refrigerant accumulated in the accumulator 26*a* (S11). Next, the liquid level detection device 27*a* calculates the amount of the refrigerant from the measured level of the liquid surface (S12). Then, the liquid level detection device 27*a* outputs the calculated amount of the refrigerant to the controller 4*a* (S13).

Figure 9:
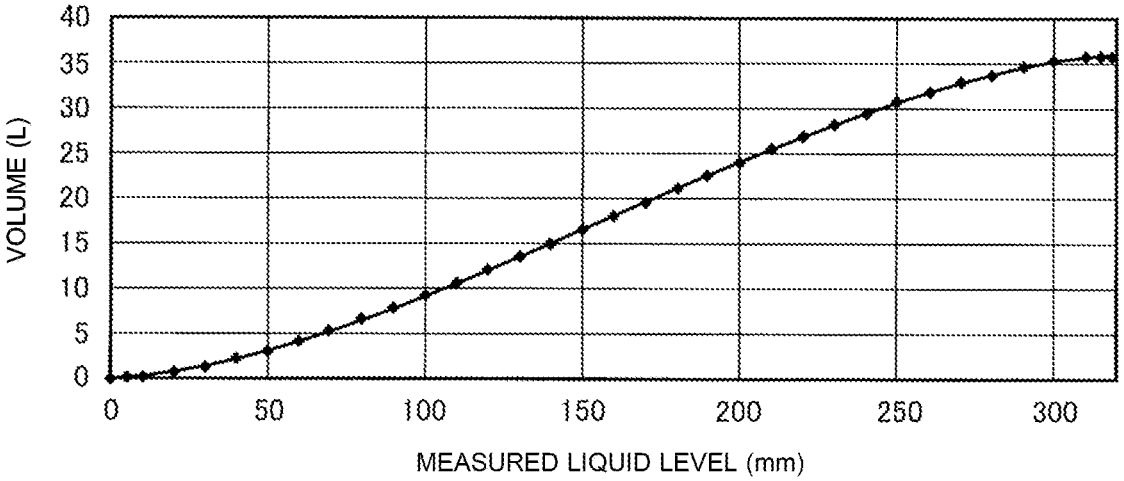
FIG. 9 is a diagram indicating an example of a relationship between a level of a liquid surface that is measured by the liquid level detection device and a volume of refrigerant accumulated in an accumulator in the embodiment.

Specifically, the liquid level detection device 27*a* calculates a volume of the liquid refrigerant from the level of the liquid surface of the surplus refrigerant accumulated in the accumulator 26*a* and specifications (for example, internal volume) of the accumulator 26*a*. FIG. 9 is a diagram illustrating an example of a relationship between the level of the liquid surface that is measured by the liquid level detection device 27*a* and the volume of the refrigerant accumulated in the accumulator, according to the embodiment.

The refrigerant has characteristics in which a density ρ [kg/m$^3$] varies depending on a pressure P measured by the pressure measurement device 28*a*. The liquid level detection device 27*a* determines the amount of the refrigerant, using an equation (1) below.

$$\text{Volume } [L]\times\rho(P)=\text{refrigerant amount [kg]} \quad (1)$$

where ρ (P) is a density determined from the pressure P.

When in step S1, the amount of refrigerant in the accumulator 26*a* is calculated, the refrigerant differential amount calculation unit 51*a* of the controller 4*a* calculates the differential amount between the amount of the surplus refrigerant accumulated in the accumulator 26*a* that is calculated by the liquid level detection device 27*a* and the amount of refrigerant in the accumulator 26*b* of the outdoor unit 2*b* (S2).

Specifically, the following equations are satisfied:

$$\text{differential amount } \Delta \text{ of refrigerant}=A-B$$

$$\text{necessary movement amount}=\Delta/2$$

where A is the liquid amount [kg] of the refrigerant that is calculated by the liquid level detection device 27*a* of the compressor 21*a* of the outdoor unit 2*a*, and B is the liquid amount [kg] of the refrigerant that is calculated by the liquid level detection device 27*b* of the compressor 21*b* of the outdoor unit 2*b*.

The following description is made re-referring to FIG. 4.

The refrigerant differential amount calculation unit 51*a* determines whether the refrigerant differential amount calculated in step S2 is zero or not (S3). In the case where in step S3, it is determined that the refrigerant differential amount is zero (YES in S3), the processing ends without performing the liquid equalization control.

In contrast, in the case where in S3, it is determined that the refrigerant differential amount is not zero (NO in S3), the liquid equalization control unit 52*a* performs the liquid equalization control of the surplus refrigerant accumulated in the accumulator 26*a* (S4).

That is, the liquid equalization control unit 52*a* controls the outdoor unit 2*a* based on the differential amount calculated by the refrigerant differential amount calculation unit 51*a* to equalize the amount of the refrigerant accumulated in the accumulator 26*a* of the outdoor unit 2*a* and the amount of the refrigerant accumulated in the accumulator 26*b* of the outdoor unit 2*b*.

More specifically, the liquid equalization control unit 52*a* controls the actuator that controls the rotational frequency of the compressor 21*a*, based on the control gain determined by the control gain determination unit 53*a*.

Figure 6:
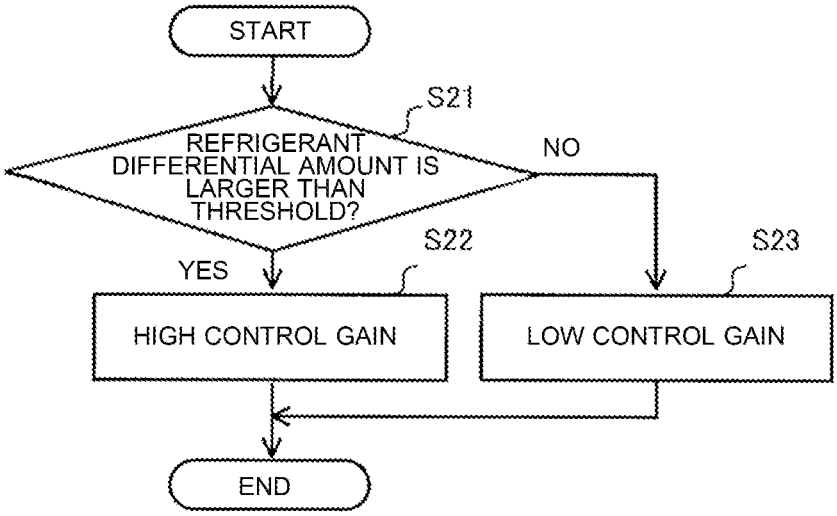
FIG. 6 is a flowchart for use in explanation of a control gain determination method by a control gain determination unit of a liquid equalization control unit 52*a* of the air-conditioning apparatus according to the embodiment.

FIG. 6 is a flowchart for use in explanation of a control gain determination method by the control gain determination unit 53*a* of the liquid equalization control unit 52*a* of the air-conditioning apparatus according to the embodiment.

As illustrated in FIG. 6, it is determined whether the refrigerant differential amount calculated by the refrigerant differential amount calculation unit 51*a* is larger than a threshold or not (S21). In the case where in step S21, it is determined that the refrigerant differential amount is larger than the threshold (YES in S21), a control gain higher than the control gain at the time of making the determination is determined (S22).

In contrast, in step S21, in the case where that it is determined that the refrigerant differential amount is not larger than the threshold (NO in S21), a low control gain is determined as the control gain (S23).

Modification 1. Refrigerant Measurement

Regarding the embodiment, it is described above that the liquid level detection device 27 calculates the amount of refrigerant accumulated in an accumulator 26. However, the liquid level detection device 27 may measure only the level of the liquid surface, and the controller 4 may calculate the amount of the refrigerant.

Furthermore, the liquid level detection device 27 may directly determine the amount of refrigerant from a predetermined density ρ without referring to the pressure P measured by the pressure measurement device 28*a*. For example, the liquid level detection device 27 may calculate the amount of refrigerant from the volume of the liquid refrigerant accumulated in the accumulator 26 and the density ρ of the refrigerant.

In addition, the liquid level detection device 27 may directly determine the amount of the refrigerant accumulated in the accumulator 26. For example, the liquid level detection device 27 may directly measure the weight of the refrigerant accumulated in the accumulator 26.

Modification 2. Regarding Calculation of Differential Amount

Regarding the embodiment, the above description is made with respect to the case where the two outdoor units are installed. In the case where three or more outdoor units are installed, a necessary movement amount is calculated in the following manner.

In the case where three outdoor units 2 are installed, the following equations are satisfied:

$$\text{average}=(A+B+C)/3$$

$$\text{necessary movement amount}=A-\text{average},B-\text{average},C-\text{average}$$

where A is a liquid amount [kg] in a first outdoor unit 2, B is a liquid amount [kg] in a second outdoor unit 2, and C is a liquid amount [kg] in a third outdoor unit 2. It should be noted that a positive movement amount is an outflow of the refrigerant, and a negative movement amount is an inflow of the refrigerant.

In the case where N outdoor units 2 are installed, the following equations are satisfied:

$$\text{average}=(A+B+C+\ldots+X)/N$$

$$\text{necessary movement amount}=A-\text{average},B-\text{average},C-\text{average},\ldots,X-\text{average}$$

where A is a liquid amount [kg] in a first outdoor unit 2, B is a liquid amount [kg] in a second outdoor unit 2, C is a liquid amount [kg] in a third outdoor unit 2, and . . . X is a liquid amount [kg] in an N-th outdoor unit 2.

Modification 3. Liquid Equalization Control

Regarding the embodiment, the above description is made with respect to the case where the magnitude of the control gain is determined based on whether the differential amount of the refrigerant is larger than the threshold. However, a plurality of thresholds may be provided, and the control gain may be determined based on the magnitudes of the thresholds.

Furthermore, the threshold for a simply measured level of a liquid surface in the accumulator may be set to, for example, a high level, a middle level, or a low level. In the case where the high level and the low level are combined, the control gain may be set to a high control gain. In the case where the high level and the middle level are combined or the middle level and the low level are combined, the control gain may be set to a low control gain.

A liquid equalization control criterion is that the refrigerant differential amount is not zero; however, the difference between the liquid levels may be applied to the criterion. Alternatively, for example, the above level of the liquid surface (the high level, the middle level, or the low level) may be applied to the criterion instead of the difference between the liquid levels.

Furthermore, time that elapses from the beginning of the liquid equalization control may be added to the criterion of determination whether or not to end the liquid equalization control.

Modification 4. Method of Moving Refrigerant Liquid

Regarding the above embodiment, the above description is made with respect to the case where the frequency of the compressor 21 is made variable to make a difference between circulation amounts of refrigerant, and the refrigerant differential amount is controlled. However, the refrigerant differential amount may be controlled by the following method.

4-1.

Figure 7:
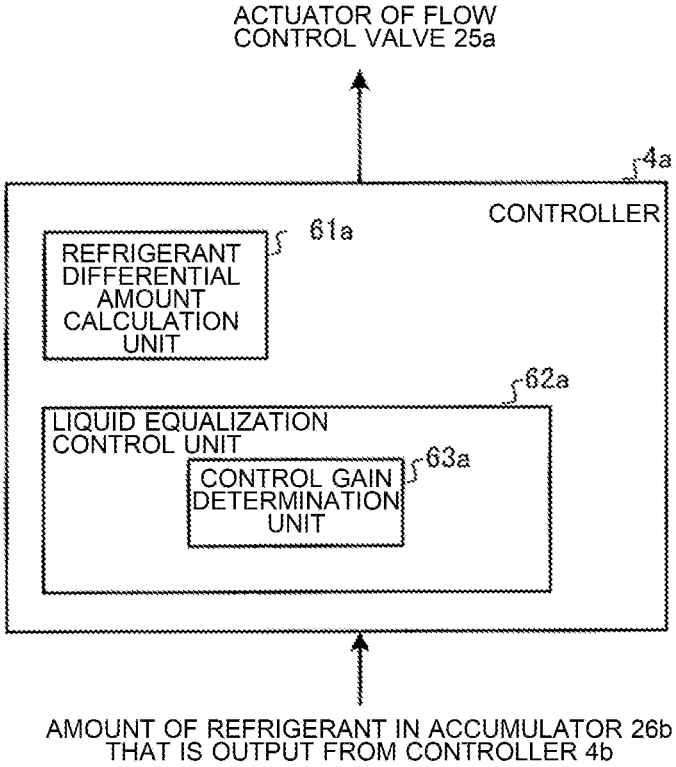
FIG. 7 is a functional block diagram illustrating functions of a controller according to modification 4-1 of the embodiment.

The opening degrees of the flow control valves 25 are made to differ from each other to adjust the refrigerant differential amount. FIG. 7 is a functional block diagram illustrating functions of the controller 4*a* according to modification 4-1 of the embodiment. It should be noted that in the figure, a functional block diagram of the controller 4*b* is omitted.

As illustrated in FIG. 7, the controller 4*a* includes a refrigerant differential amount calculation unit 61*a* and a liquid equalization control unit 62*a*.

The refrigerant differential amount calculation unit 61*a* calculates a differential amount between an amount of the surplus refrigerant accumulated in the accumulator 26*a* that is calculated by the liquid level detection device 27*a* and the amount of the refrigerant in the accumulator 26*b*. Regarding the embodiment, the above description is made with respect to the case where the two heat source apparatuses each including the accumulator are provided; however, in the case where three or more heat source apparatuses are provided, a differential amount between the amount of the surplus refrigerant accumulated in the accumulator 26*a* that is calculated by the liquid level detection device 27*a* and an average amount of amounts of the refrigerant accumulated in respective accumulators of the heat source apparatuses is calculated as described below.

The liquid equalization control unit 62*a* controls the outdoor unit 2*a* based on the differential amount calculated by the refrigerant differential amount calculation unit 61*a* to equalize the amount of the refrigerant accumulated in the accumulator 26*a* of the outdoor unit 2*a* and the amount of the refrigerant accumulated in the accumulator 26*b* of the outdoor unit 2*b*. Specifically, the liquid equalization control unit 62*a* controls the opening degree of the flow control valve 25*a*.

More specifically, the liquid equalization control unit 62*a* includes a control gain determination unit 63*a*. The control gain determination unit 63*a* determines the opening degree of the flow control valve 25*a* based on the differential amount calculated by the refrigerant differential amount calculation unit 61*a*. The liquid equalization control unit 62*a* controls an actuator that controls the opening degree of the flow control valve 25*a*, based on the control gain determined by the control gain determination unit 63*a*.

4-2.

Figure 8:
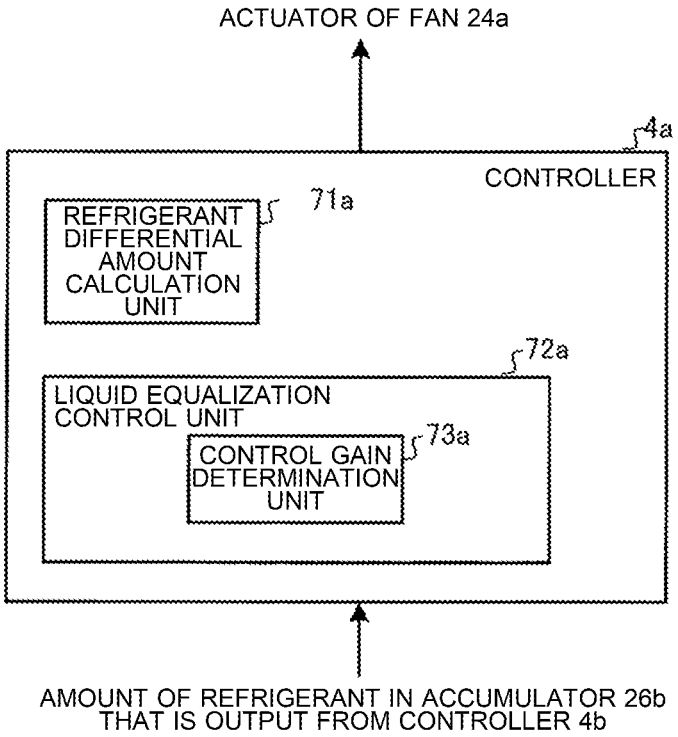
FIG. 8 is a functional block diagram illustrating functions of a controller according to modification 4-2 of the embodiment.

During the heating operation, an evaporation amount control unit controls an evaporation amount in an outdoor-unit heat exchanger 23 to control the refrigerant differential amount. As the evaporation amount control unit, a fan 24 is described as an example. The evaporation amount control unit may be a flow control valve controlling a flow rate of a water heat exchanger. FIG. 8 is a functional block diagram illustrating functions of the controller 4*a* according to modification 4-2 of the embodiment. Note that a functional block diagram of the controller 4*b* is omitted.

As illustrated in FIG. 8, the controller 4*a* includes a refrigerant differential amount calculation unit 71*a* and a liquid equalization control unit 72*a*.

The refrigerant differential amount calculation unit 71*a* calculates a differential amount between the amount of the surplus refrigerant accumulated in the accumulator 26*a*, calculated by the liquid level detection device 27*a* and the amount of the refrigerant in the other accumulator 26*b*. Regarding the embodiment, the above description is made with respect to the case where the two heat source apparatuses each including the accumulator are provided; however, in the case where three or more heat source apparatuses are provided, a differential amount between the amount of the surplus refrigerant accumulated in the accumulator 26*a* that is calculated by the liquid level detection device 27*a* and an average amount of amounts of the refrigerant accumulated in respective accumulators of the heat source apparatuses is calculated as described below.

The liquid equalization control unit 72*a* controls the outdoor unit 2*a* based on the differential amount calculated by the refrigerant differential amount calculation unit 71*a* to equalize the amount of the refrigerant accumulated in the accumulator 26*a* of the outdoor unit 2*a* and the amount of the refrigerant accumulated in the accumulator 26*b* of the outdoor unit 2*b*. Specifically, the liquid equalization control unit 72*a* controls the fan 24*a* that controls an evaporation amount of refrigerant.

More specifically, the liquid equalization control unit 72*a* includes a control gain determination unit 73*a*. The control gain determination unit 73*a* determines a control gain of the fan 24*a* based on the differential amount calculated by the refrigerant differential amount calculation unit 71*a*. The liquid equalization control unit 72*a* controls an actuator of the fan 24*a* that controls the evaporation amount of refrigerant, based on the control gain determined by the control gain determination unit 73*a*.

4-3.

A path through which liquid refrigerant passes as a bypass and a path through which gas refrigerant passes as a bypass are used, and the state of an inlet of each of the accumulators 26 is controlled to control the refrigerant differential amount.

The necessary movement amount of the refrigerant of each of the outdoor units 2 is defined as described regarding S2 of FIG. 4 and modification 2.

With respect to the operation of each actuator described regarding the liquid movement method, the refrigerant equalization operation can be ended in a short time by an arbitrary control by a setter. Furthermore, when a low gain is intentionally set, the refrigerant equalization operation can be performed for a certain time while unbalance between the heat source apparatuses is minimized.

For example, in a circuit in which each of the flow control valves 25 is provided upstream of the heat-source-apparatus heat exchanger during the heating operation, the refrigerant differential amount can be adjusted by a difference between the opening degrees of the flow control valves 25. When the necessary movement amount is calculated as X [kg] by the measurement by the liquid level detection device 27, and in the case where a refrigerant amount M1 of a first heat source>a refrigerant amount M2 of a second heat source is satisfied, the operation can be ended in a short time by setting the opening degree of the flow control valve 25 of the first heat source apparatus to y and setting the opening degree of the flow control valve 25 of the second heat source apparatus to Z. When the opening degree of the flow control valve 25 of the first heat source apparatus is set to Y and the opening degree of the flow control valve 25 of the second heat source apparatus is set to Z, the operation can be performed for a certain time while unbalance between the heat source apparatuses is minimized.

<Description of Reference Signs and Magnitude Relationship>

Necessary movement amount=*X*

Refrigerant amount M1>M2 (movement of refrigerant from M1 to M2 is necessary) Opening degree of flow control valve Y<Z inflow of refrigerant to Y side (first heat source side) is reduced.

y<Z inflow of refrigerant to y (first heat source side) is reduced.

y<Y movement amount is large because difference from Z is larger when Y is set.

=refrigerant movement in a short time is possible.

Furthermore, the setting of the opening degree the flow control valve 25 as described above is an example of the setting of the opening degree setting that is performed once at the time of performing the liquid equalization control. In the opening degree setting, in the case where the liquid refrigerant cannot be moved by one operation, the liquid can be reliably moved by gradually decreasing the opening degree in the following order. Y; Y−1; Y−2; . . . , Y−N. In other words, the control gain determination unit 53 may determine a control gain different from a previously determined control gain.

The example of the liquid movement by the flow control valve 25 is described above. Also, the liquid movement based on the frequency of the compressor 21 and the liquid movement based on the evaporation amount control of the outdoor-unit heat exchanger 23 as described above are performed in a similar manner.

The air-conditioning apparatus 1 according to the embodiment includes the liquid level detection devices 27. Therefore, it is possible to accurately grasp the amounts of the refrigerant accumulated in the respective accumulators 26 in the air-conditioning apparatus 1 without being affected by the degree of discharge superheat of each of the compressors 21 and the kind of the refrigerant. As a result, it is possible to perform an accurate liquid equalization control.

Furthermore, the operation to maintain equality between the liquid amounts in the accumulators 26 is performed after the amounts of the surplus refrigerant in the accumulators 26 of the heat source apparatuses each including the liquid level detection device 27 is accurately grasped. It is therefore possible to set the target movement amount, etc., before performance of the refrigerant equalization operation, whereby a control time can be reduced. In other words, it is possible to minimize lowering of the air-conditioning performance that is caused by the refrigerant equalization operation.

The embodiment is described as an example, and is not intended to limit the scope of the embodiment. The embodiment can be variously modified, and various omissions, replacements, and modifications can be made without departing from the gist of the embodiment. The embodiment and the modifications thereof are included in the scope and the gist of the embodiment.

REFERENCE SIGNS LIST

1: air-conditioning apparatus, 2, 2*a*, 2*b*: outdoor unit, 3, 3*a*, 3*b*: indoor unit, 4, 4*a*, 4*b*: controller, 21, 21*a*, 21*b*: compressor, 22, 22*a*, 22*b*: four-way valve, 23, 23*a*, 23*b*: outdoor-unit heat exchanger, 24, 24*a*, 24*b*: fan, 25, 25*a*, 25*b*: flow control valve, 26, 26*a*, 26*b*: accumulator, 27, 27*a*, 27*b*: liquid level detection device, 28, 28*a*, 28*b*: pressure measurement device

The invention claimed is:

1. An air-conditioning apparatus including a plurality of heat source apparatuses each including a compressor and an accumulator configured to accumulate refrigerant to be compressed by the compressor, the air-conditioning apparatus comprising:

a refrigerant amount calculation unit configured to calculate an amount of the refrigerant accumulated in the accumulator in one of the plurality of heat source apparatuses that is to be controlled;

a refrigerant differential amount calculation unit configured to calculate, in a case where the number of the plurality of heat source apparatuses is two, a differential amount between the amount of the refrigerant that is calculated by the refrigerant amount calculation unit and an amount of the refrigerant in the accumulator in an other one of the heat source apparatuses, and configured to calculate, in a case where the number of the plurality of heat source apparatuses is three or more, a differential amount between the amount of the refrigerant that is calculated by the refrigerant amount calculation unit and an average amount of amounts of the refrigerant accumulated in the accumulators in the plurality of heat source apparatuses; and a liquid equalization control unit configured to control the heat source apparatus to be controlled, based on the differential amount calculated by the refrigerant differential amount calculation unit, to thereby equalize the amounts of the refrigerant accumulated in the accumulators in the plurality of heat source apparatuses, wherein the refrigerant amount calculation unit configured to:

measure a level of a liquid surface of the refrigerant accumulated in the accumulator in the heat source apparatus to be controlled, and calculate the amount of the refrigerant accumulated in the accumulator in the heat source apparatus to be controlled, based on the measured level of the liquid surface, a volume of the accumulator in the heat source apparatus to be controlled, and a density of the refrigerant.

2. The air-conditioning apparatus of claim 1, further comprising a pressure measurement device configured to measure a pressure of the refrigerant in the accumulator in the heat source apparatus to be controlled, wherein the density of the refrigerant is calculated based on the pressure measured by the pressure measurement device.

3. The air-conditioning apparatus of claim 1, wherein the liquid equalization control unit is configured to control a rotational frequency of the heat source apparatus to be controlled.

4. The air-conditioning apparatus of claim 1, further comprising a flow control valve configured to control a flow rate of refrigerant that flows in the heat source apparatus to be controlled, wherein the liquid equalization control unit is configured to control an opening degree of the flow control valve.

5. The air-conditioning apparatus of claim 1, wherein the heat source apparatus to be controlled further includes a heat exchanger and a refrigerant evaporation amount control unit configured to control an evaporation amount of refrigerant at the heat exchanger, and the liquid equalization control unit is configured to control the refrigerant evaporation amount control unit.

6. The air-conditioning apparatus of claim 3, further comprising a control gain determination unit configured to determine a control gain of a rotational frequency of the compressor in the heat source apparatus to be controlled, based on the differential amount calculated by the refrigerant differential amount calculation unit, wherein the liquid equalization control unit controls an actuator configured to control the rotational frequency of the compressor in the heat source apparatus to be controlled, based on the control gain determined by the control gain determination unit.

7. The air-conditioning apparatus of claim 4, further comprising a control gain determination unit configured to determine a control gain of an opening degree of the flow control valve, based on the differential amount calculated by the refrigerant differential amount calculation unit, wherein the liquid equalization control unit is configured to control an actuator configured to control the opening degree of the flow control valve, based on the control gain determined by the control gain determination unit.

8. The air-conditioning apparatus of claim 5, further comprising a control gain determination unit configured to determine a control gain of the refrigerant evaporation amount control unit, based on the differential amount calculated by the refrigerant differential amount calculation unit, wherein the liquid equalization control unit is configured to control an actuator configured to control the evaporation amount of refrigerant that is controlled by the refrigerant evaporation amount control unit, based on the control gain determined by the control gain determination unit.

9. The air-conditioning apparatus of claim 6, wherein the control gain determination unit is configured to determine a control gain different from a previously determined control gain, when determining the control gain.

10. A method of controlling an air-conditioning apparatus, the air-conditioning apparatus including a plurality of heat source apparatuses including respective compressors and respective accumulators each configured to accumulate refrigerant to be compressed by an associate one of the compressors, the method comprising:

calculating an amount of the refrigerant accumulated in the accumulator in one of the heat source apparatus that is to be controlled;

calculating, in a case where the number of the plurality of heat source apparatuses is two, a differential amount between the calculated amount of the refrigerant and an amount of the refrigerant in an other of the accumulators, and in a case where the number of the plurality of heat source apparatuses is three or more, a differential amount between the calculated amount of the refrigerant and an average amount of amounts of the refrigerant accumulated in the accumulators in the plurality of heat source apparatuses; and controlling the heat source apparatus including the accumulator in the heat source apparatus to be controlled, based on the calculated differential amount, to thereby equalize the amounts of the refrigerant accumulated in the accumulators in the plurality of heat source apparatuses, the calculating the amount of the refrigerant includes measuring a level of a liquid surface of the refrigerant accumulated in the accumulator in the heat source apparatus to be controlled, and calculating the amount of the refrigerant accumulated in the accumulator in the heat source apparatus to be controlled, based on the measured level of the liquid surface, a volume of the accumulator in the heat source apparatus to be controlled, and a density of the refrigerant.

* * * * *